US010641033B2

(12) United States Patent
Lambertini

(10) Patent No.: US 10,641,033 B2
(45) **Date of Patent: *May 5, 2020**

(54) SASH FOR DOORS OR WINDOWS AND DOOR OR WINDOW OBTAINED WITH THE SASH

(71) Applicant: GO TECHNOLOGY S.R.L., Villanova di Castenaso (IT)

(72) Inventor: Marco Lambertini, San Lazzaro di Savena (IT)

(73) Assignee: GO TECHNOLOGY S.R.L., Fraz.Villanova (IT)

( * ) Notice: Subject to any disclaimer, the term of this patent is extended or adjusted under 35 U.S.C. 154(b) by 163 days.

This patent is subject to a terminal disclaimer.

(21) Appl. No.: 15/761,666

(22) PCT Filed: Sep. 21, 2016

(86) PCT No.: PCT/IB2016/055624

§ 371 (c)(1),
(2) Date: Mar. 20, 2018

(87) PCT Pub. No.: WO2017/051323

PCT Pub. Date: Mar. 30, 2017

(65) Prior Publication Data

US 2018/0347257 A1 Dec. 6, 2018

(30) Foreign Application Priority Data

Sep. 21, 2015 (IT) ..... 102015000053584

(51) Int. Cl.
*E06B 3/00* (2006.01)
*E06B 3/02* (2006.01)
(Continued)

(52) U.S. Cl.
CPC ..... *E06B 3/025* (2013.01); *E06B 3/66342* (2013.01); *E06B 7/22* (2013.01)

(58) Field of Classification Search
CPC ..... E06B 3/02; E06B 3/66342; E06B 7/22
(Continued)

(56) References Cited

U.S. PATENT DOCUMENTS 4,496,201 A * 1/1985 Allgeyer ..... A47F 3/043 312/296
4,741,127 A * 5/1988 Bockwinkel ..... A47F 3/043 312/296

(Continued)

FOREIGN PATENT DOCUMENTS

CN 103741872 A 4/2014
DE 29812574 U1 11/1998

(Continued)

OTHER PUBLICATIONS

International Search Report and Written Opinion dated Nov. 8, 2016 for counterpart PCT Application No. PCT/IB2016/055598.

(Continued)

*Primary Examiner* — Jerry E Redman
(74) *Attorney, Agent, or Firm* — Shuttleworth & Ingersoll, PLC; Timothy J. Klima

(57) ABSTRACT

A sash for doors or windows includes two spaced apart glass sheets, a spacer element interposed between the sheets to define a closed inner perimeter zone and an open outer perimeter zone. A structural sealing/adhesion component runs along the outer perimeter zone and occupies a volume to permit contact with the spacer element and the glass sheets. An element for housing accessory components for supporting and/or operating the sash is associated with the structural component, for each side of the glass sheets. Each element includes a rigid profile associated with the structural component and having a closed base side, two flaps each formed by a stretch perpendicular to the base side and a recessed stretch, parallel to the base side, to form a channel (Continued)

with an opening. A rigid plate is adhesively associated with one of the glass sheets to cover an outer edge thereof.

12 Claims, 5 Drawing Sheets

(51) Int. Cl.
*E06B 3/663* (2006.01)
*E06B 7/22* (2006.01)

(58) Field of Classification Search
USPC ..... 49/501, DIG. 1, DIG. 2
See application file for complete search history.

(56) References Cited

U.S. PATENT DOCUMENTS 4,948,206 A * 8/1990 Fitzpatrick ..... A47F 3/043 312/296
4,961,975 A * 10/1990 Bejnar ..... E06B 3/5427 156/109
4,998,382 A * 3/1991 Kostos ..... A47F 3/043 49/501
5,255,473 A * 10/1993 Kaspar ..... A47F 3/043 49/501
RE35,149 E * 1/1996 Richardson ..... A47F 3/043 49/501
5,584,143 A 12/1996 Kennedy
6,148,563 A * 11/2000 Roche ..... A47F 3/0434 49/501
6,260,255 B1 * 7/2001 Richardson ..... A47F 3/0434 29/458
6,318,036 B1 * 11/2001 Siudzinski ..... E06B 1/28 49/366
8,464,467 B2 6/2013 Lambertini
10,378,270 B2 * 8/2019 Lambertini ..... E06B 3/50
2002/0056184 A1 5/2002 Richardson et al.
2011/0308169 A1 12/2011 Lambertini

FOREIGN PATENT DOCUMENTS

DE 102012215297 A1 3/2014
EP 0228641 A2 7/1987
EP 0381646 A1 8/1990
EP 0937856 A2 8/1999
EP 2315900 A1 5/2011
EP 2546448 A2 1/2013
EP 2628883 A2 8/2013
EP 2722473 A2 4/2014
FR 2572766 A1 5/1986
WO 9802632 A1 1/1998
WO 9816711 A1 4/1998
WO WO2010097776 A1 9/2010
WO 2016150712 A1 9/2016

OTHER PUBLICATIONS

Italian Search Report dated Mar. 7, 2016 for counterpart Italian Application No. IT UB20153774.
Chinese Office Action dated Nov. 5, 2018 from counterpart Chinese Patent App No. 201680054614.6.
Chinese Office Action dated Nov. 5, 2018 for counterpart Chinese Patent Application No. 201680054706.3.
International Search Report and Written Opinion dated Nov. 30, 2016 for counterpart PCT Application No. PCT/IB2016/055624.
Italian Search Report dated Mar. 7, 2016 for counterpart Italian Application No. IT UB20153763.

* cited by examiner

SASH FOR DOORS OR WINDOWS AND DOOR OR WINDOW OBTAINED WITH THE SASH

This application is the National Phase of International Application PCT/IB2016/055624 filed Sep. 21, 2016 which designated the U.S.

This application claims priority to Italian Patent Application No. 102015000053584 filed Sep. 21, 2015, which application is incorporated by reference herein.

TECHNICAL FIELD

This invention relates to a sash for doors or windows.

This invention also relates to a door or window obtained with the sash.

More specifically, this invention is used for a sash for tilt or turn doors or windows.

BACKGROUND ART

In the technical field relative to the formation of sashes for doors and windows, the design comprises two essential components: the so-called double glazing unit and the supporting frame for the double glazing unit and the functional accessories relating to the correct assembly and use of the sash formed.

Usually, the double glazing unit comprises:

at least a pair of sheets of glass (with equal or different perimeter dimensions according to the planned use) positioned facing each other and parallel to each other a spacer and joining element positioned on the four sides formed by the sheets of glass;

a structural component made of synthetic material applied along the outer perimeter defined by the spacer in order to increase the physical characteristics of the double glazing unit formed and also to increase the thermal insulation of the chamber present between the two sheets of glass and the seal to moisture.

The frame which mounts the double glazing comprises:

a pair of uprights and crosspieces made of a metallic material associated with the edges of the double glazing unit to form the supporting frame of the double glazing unit;

each of the uprights and the crosspieces has a tubular profile shaped to define accessory zones for application of seals and at least one longitudinal channel for applying functional elements (for example, hinges) or elements for operating/closing the sash such as slidable rods or striker elements.

This frame interacts with the fixed counterframe applied to the opening of the room in which the sash is mounted. The fixed counterframe has a profile and accessories which share the accessories present on the frame of the sash.

This type of, so-called, traditional sash structure, even though functionally reliable, has limits of an aesthetic, assembly time and costs and thermal sealing type.

For these reasons, attempts have been made, over time, to modify the basic structures to obtain better results in terms of appearance, rationalisation of frame components and thermal sealing characteristics.

Examples of prior art solutions which are able to modify the structure of the sash frame are known from patent documents EP2315900 and EP2722473 (in the name of the same Applicant as this invention) wherein the frame is without uprights and crosspieces and the perimeter edges of the sheets of glass (forming a cavity) are used to house only the tubular parts of the metal profile useful for applying the supporting and operating accessories and the sash closing/opening accessories associated with the sheets of glass.

Another prior art solution is described in patent document FR 2572766 wherein the frame consists of a hybrid rubber-metal structure.

In other words, a rubber block is housed inside the cavity of the double glazing unit (associated on both sides only to the inner part of the sheets of glass) equipped with a shaped seat which houses, at least partially, in slidable coupling mode (before assembly on the double glazing unit) a complete metal profile configured to define both the seats for housing the control and operating accessories and the lateral actuation accessories such as a handle which are connected by subsequent machining on one of the sheets of glass and on the rubber.

Another solution is known in the prior art from patent document EP 937.856 wherein a frame structure is associated with an inner surface of one of the sheets of glass. The frame comprises a first lower half-chamber supporting the operating components and a second tubular chamber designed to guarantee the passage of the screws for fixing the operating components.

The frame is located asymmetrically and rests fully on the largest sheet of glass with the relative adhesive glue, whilst the other side, the difference in distance is compensated by a greater use of structural component and/or glue.

This embodiment of a sash has the drawback of reduced structural sealing; the frame is asymmetrical and has two different tubularities so it does not represent a structural component with mechanical sealing for the pair of sheets of glass and can be used only on pairs of sheets of glass of different dimensions, that is, with reduced adaptation to frames of different dimensions and types of opening.

Moreover, the sash using this frame must necessarily have a satin-finish machining on the edges of the outer surfaces of the sheet of glass to obscure the part of adhesive used to associate the part(s) of frame to the inner surfaces of the sheets of glass.

This results in additional costs and an appearance which is not always acceptable.

These solutions, although they are a considerable improvement with respect to the structure of the traditional sash, have still not eliminated some of the drawbacks, such as weight of the sash, reduction in component and assembly costs and, also, the possibility of adapting the sash to fixed counterframes which are already mounted.

There is currently a greatly felt need for the adaptability of the sash also to counterframes already present since it would drastically reduce the replacement costs without involving invasive and awkward works in closed environments.

Another need felt, in the solutions with glass on view, is also to cover the end areas or free edges of the sheets of glass, mainly for aesthetical reasons and, secondarily, also for structural technical reasons.

In the above-mentioned solutions, the edges of the sheets of glass are covered by adhesive strips or by satin-finish machining of the edges themselves.

However, these solutions have drawbacks, since the strips are difficult to replace (for example, due to a different tone of colour or in the case of a worn or broken strip).

The satin-finish machining means that the appearance of the sash can longer be modified and it is necessary to replace it if different appearances are chosen.

DISCLOSURE OF THE INVENTION

This invention has for an aim to provide a door or window sash that overcomes the above mentioned disadvantages of the prior art.

More specifically, the aim of this invention is to provide a sash for doors or windows which is able to maintain the operational reliability of the traditional type sashes combined with a good appearance.

A further aim of this invention is to propose a sash for doors or windows which increases the possibility of changing the appearance of the sash in a fast, simple and inexpensive manner.

These aims are fulfilled by the sash for doors or windows having features as disclosed herein.

More specifically, the sash for doors or windows comprises a first and a second sheet of glass positioned facing each other and parallel to each other at a mutual distance.

The sash also comprises a spacer and joining element interposed between two inner surfaces facing each other of the two sheets of glasses to define a first closed inner perimeter zone or chamber and a second open outer perimeter zone or cavity for each side defined by the pair of sheets of glass.

The sash also comprises a structural sealing/adhesion component applied along the outer perimeter defined by the cavity.

The structural component occupies a volume of the cavity which is able to allow contact of the structural component at least with the spacer element and with a part of the inner surfaces of the two sheets of glass.

According to the invention, the sash also comprises at least an element for housing accessory components for supporting and/or operating the sash associated with the structural component, for each side defined by the first and second sheet of glass.

Again according to the invention, each element is comprised of a rigid profile having, in cross section, at least one closed base side and two flaps each formed by a stretch perpendicular to the base side and a recessed stretch, parallel to the base side, to form a channel with an opening.

Again according to the invention, the rigid profile is associated with the structural component at least along the outer surface of the base side.

Again according to the invention, the rigid profile comprises an anchoring rib projecting from the outer surface of the base side and immersed in the structural component; the anchoring rib has, in cross section, a form of a keel extending with its vertex towards the spacer element.

Again according to the invention, the sash also comprises a rigid plate, for at least one side of one of the first and second sheets of glass, having a first portion associated, by removable adhesion means to the edge of an outer surface of one of the sheets of glass, opposite the corresponding inner surface defining the cavity, for covering the edge.

This sash structure allows an extremely high quality standard to be obtained, both from a technical and aesthetic point of view.

In addition, the times and costs for making this sash are extremely reduced, whilst maintaining high levels of sealing and functionality.

The presence of the rigid plate makes the appearance of the sash flexible, as it is possible to modify and adapt the colours of the frame of the sash according the needs of the user, as well as covering functional parts of the inner compartment of the sash itself.

BRIEF DESCRIPTION OF THE DRAWINGS

This and other features will become more apparent from the following description of a preferred embodiment of the invention, illustrated by way of non-limiting example in the accompanying tables of drawings, in which.

DETAILED DESCRIPTION OF PREFERRED EMBODIMENTS OF THE INVENTION

Figure 1:
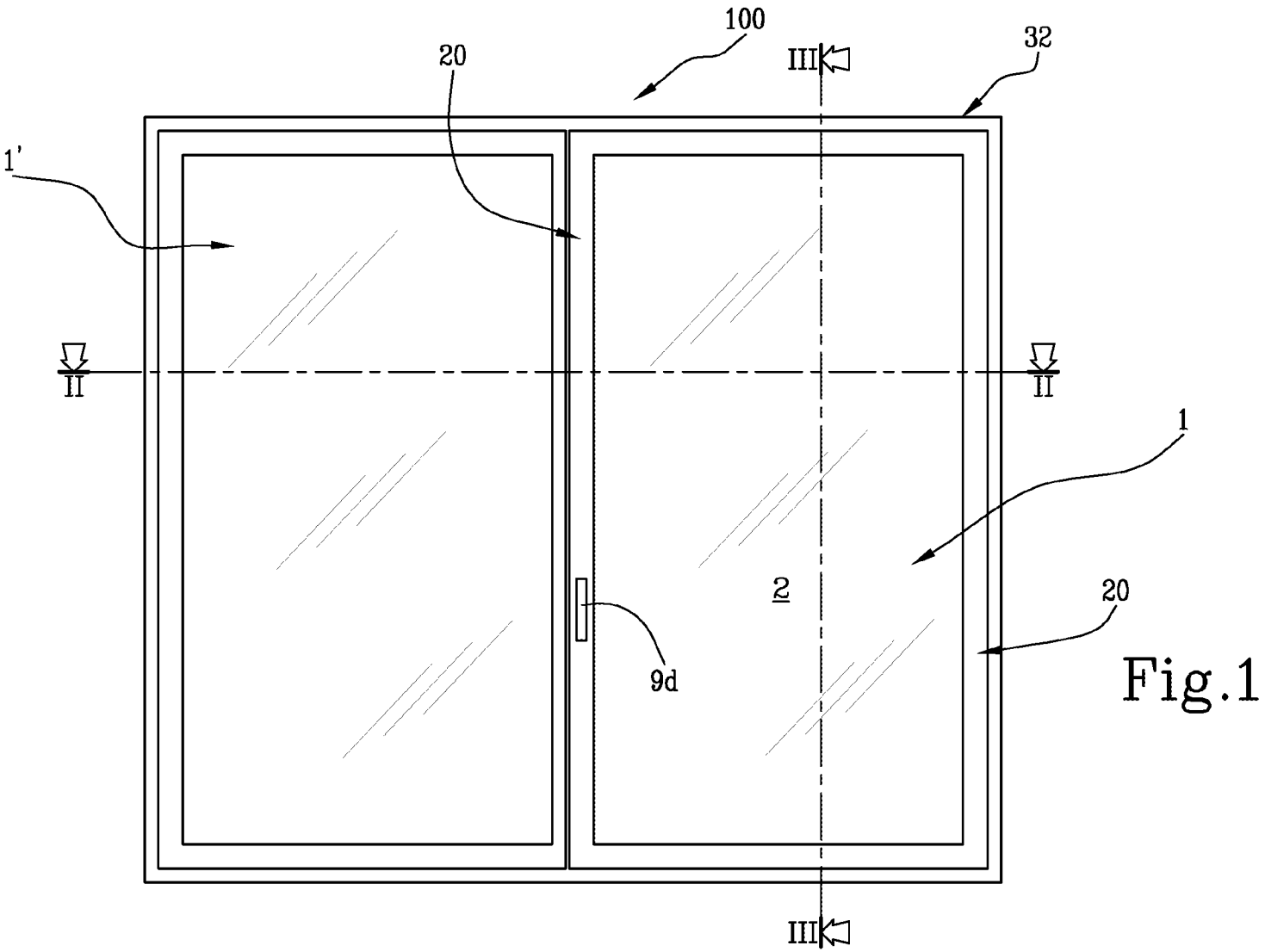
FIG. 1 illustrates a schematic front view of a window obtained with the sash for doors or windows according to this invention.

With reference to the accompanying drawings, and with particular attention to FIG. 1, the sash according to the invention, labelled 1 in its entirety, is used for making doors or windows 100 with opening by turning or by turning and tilting and with single or double sash configurations.

The doors or windows 100 of particular interest comprise a fixed frame 32 on which the sash 1 is articulated by hinges (not illustrated).

The sash 1 may, therefore, rotate about a vertical axis and also (in the case of tilting movements) about a horizontal axis to move from a closed position to an open and vice versa.

The sash 1, as described below, is equipped with control and operating components to allow the opening and closing configurations.

The sash 1 for doors or windows comprises (see FIGS. 2 and 3) at least a first 2 and a second 3 sheet of glass positioned facing each other and parallel to each other at a mutual distance D.

The sash 1 also comprises a spacer and joining element 4 interposed between two inner surfaces 2*a*, 3*a* facing each other of the two sheets of glasses 2, 3 to define a first closed inner perimeter zone or chamber 5 and a second open outer perimeter zone or cavity 6 for each side defined by the pair of sheets of glass 2, 3 (in this example there are four sides).

Again, the sash 1 comprises a structural sealing/adhesion component 7 applied along the outer perimeter defined by the cavity 6.

In light of this, the structural component 7 occupies a volume P of the cavity 6 which is able to allow contact of the structural component 1 at least with the spacer element 4 and with a part of the inner surface 2*a*, 3*a* of the two sheets of glass 2, 3.

According to the invention, the sash 1 comprises, for each side defined by the first and second glass 2, 3, at least an element 8 for housing accessory components 9*a*, 9*b*, 9*c*, 9*d* for supporting and/or operating the sash 1 associated with the structural component 7.

Again according to the invention, each element 8 is comprised of a rigid profile having, in cross section, at least one closed base side 9 and two flaps 10 and 11 each formed by a stretch 12 transversal to the base side 9 and a recessed stretch 13, parallel to the base side 9, to form a channel (in the form of a rotated "C") with an opening 14.

Preferably, the transversal stretch 12 is positioned perpendicular to the base side 9.

Also according to the invention, the rigid profile is associated with the structural component 7 at least along the outer surface of the base side 10.

Again according to the invention, the rigid profile 8 comprises at least one anchoring rib 15 projecting from the outer surface of the base side 9 and immersed in the structural component 7.

The anchoring rib 15 has, in cross section, a form of a keel extending with its vertex towards the spacer element 4.

Also according to the invention, the sash 1 comprises a rigid plate 20 (independent), for at least one side of one of the first 2 and second 3 sheets of glass (in the case illustrated, the one indicated with the numeral 2), having at least a first portion 21 associated, by removable adhesion means 22 to the edge of an outer surface 2*b* of one of the sheets of glass 2, 3, opposite the corresponding inner surface 2*a*, defining the cavity 6, for covering at least the edge.

In other words, a cover, which can be replaced, is applied on at least an outer edge side of one of the sheets of glass (in particular, the one to be fitted inside the room in which the sash is mounted), directly on the glass surface.

Preferably, the sash 1 comprises a rigid plate 20 for each side of one of the first 2 and second 3 sheets of glass to cover the outer edge perimeter of the first 2 or second 3 sheet of glass, to be fitted inside the room in which the sash 1 is mounted.

It should therefore be noted that the outer surface of a sheet of glass 2 is "edged" by a cover of the desired colour. The cover may be applied during assembly of the sash 1 or also when the sash 1 is already assembled and just before being applied on the fixed frame 32, without necessarily dismantling structural components of the sash 1.

Preferably, the rigid plate 20 comprises a second portion 23 protruding from the edge of the sheet of glass 2 and parallel towards the outside of the sheet of glass 2.

The second portion 23 of the rigid plate 20 may be present for covering more of the parts of the volume of the cavity 6 of the sash 1 in which there are functional components.

Basically, the plate 20 may be structured like a simple cover of the outer edge of the sheet of glass 2 or 3, that is, with only the first portion 21, or in a combined version with the second portion 23 which forms a sort of larger covering wing and, at the same time, a technical component for supporting sealing elements or elements for controlling operation of the sash 1.

Preferably, the rigid plate 20 has the first portion 21 equipped with a seat 24 having an inner volume for partially containing the removable adhesion means 22.

In light of this, the removable adhesion means 22 are interposed between the inner part of the seat 24 and a stretch of the outer surface 2*b* of the edge of the first sheet of glass 2.

In a first solution, the removable adhesion means 22 comprise a strip of two-sided adhesive material. The strip has a thickness configured for engaging the internal volume of the seat 24, but without protruding from the edge of the seat 24.

The seat 24 consists of a profile (illustrated in the drawing as a non-limiting example with a substantially "C" shape) with opening towards the glass surface 2*b* of the sheet of glass 2.

In a second solution, the removable adhesion means 22 comprise a strip of removable adhesive applied between the seat 24 of the rigid plate 20 and the edge of the first sheet of glass 2.

Figure 2:
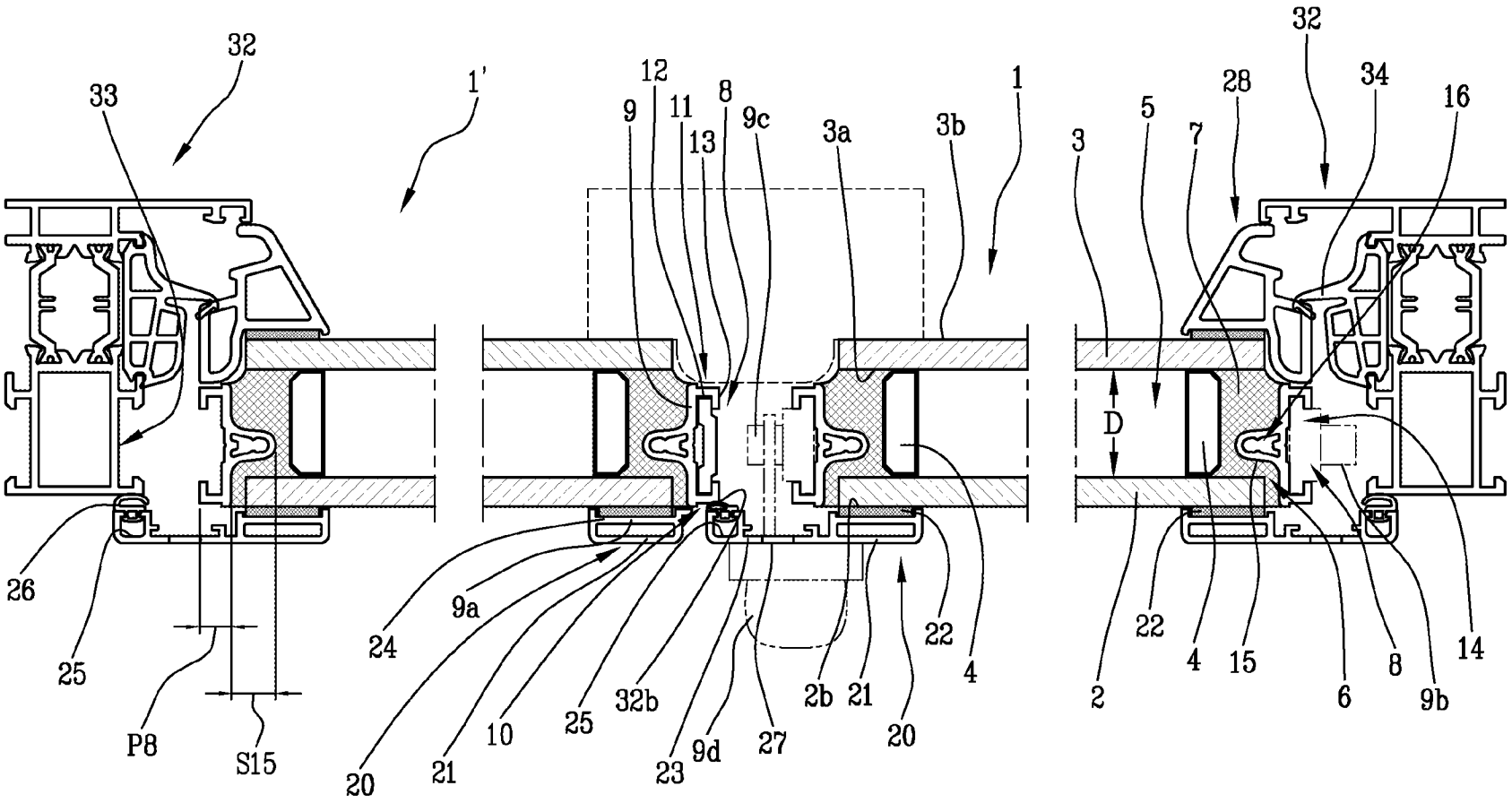
FIG. 2 is a cross-section through line II-II, referred to FIG. 1, of the sash for doors or windows according to the invention, with some parts cut away.
Figure 3:
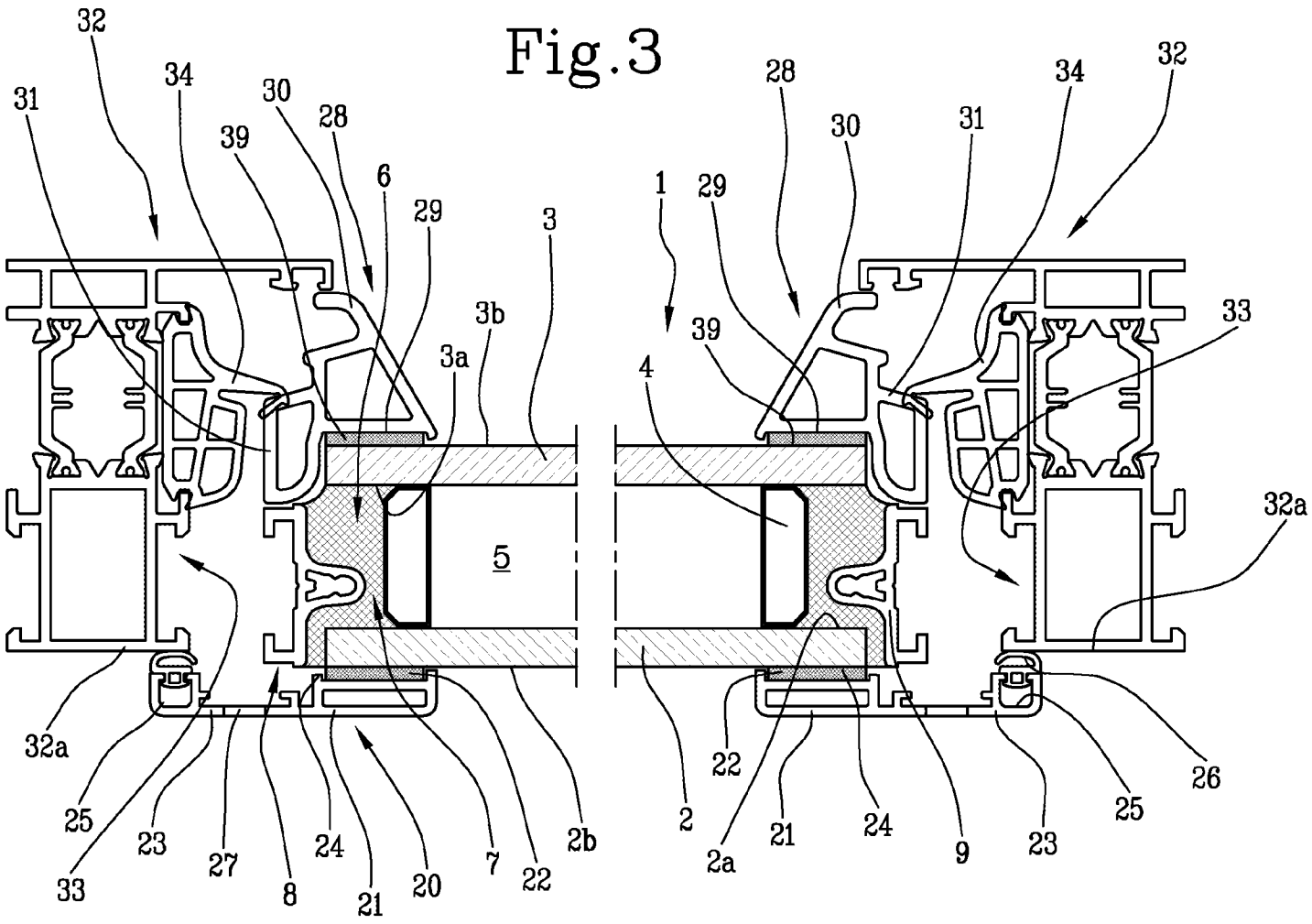
FIG. 3 is a cross-section through line III-III, referred to FIG. 1, of a second embodiment of a sash for doors or windows according to the invention, with some parts cut away.

Preferably, the first and the second 2 and 3 sheet of glass have equal perimeter dimensions (see FIGS. 2 and 3).

In light of this, the structural component 7 occupies the entire volume of the cavity 6 defined.

It should be noted that the rigid profile 8 is positioned protruding from the cavity 6.

Preferably, the rigid plate 20 has a free end of the second portion 23 equipped with a profile 25 for coupling with a seal 26.

More specifically, the profile is obtained on the surface of the second portion 23 facing, in use, towards the cavity 6.

Preferably, the rigid plate 20 has the second portion 23 equipped with at least one through seat 27 for the coupling and support of a member 9*d* (handle) for controlling the sash 1.

In short, the presence of the second portion 23 of the rigid plate 20 also has the aim of supporting the appearance with a more strictly technical auxiliary function of supporting and positioning technical accessories.

The sash 1 also comprises a rear covering profile 28 associated, through removable adhesion means 39, with each edge of the outer surface 3*b*, 2*b* of the other sheet of glass 3, 2 (in this case, the sheet of glass with the numeral 3).

In light of this, the profile 28 has:

a first portion 29 in contact with the surface 3*b* of the edge of the sheet of glass 3;

a second portion 30 configured away at least transversally relative to the edge of the sheet of glass 3; and a third portion 31 projecting beyond the free end of the edge of the sheet of glass 3.

This further profile 29 may complete, from a technical point of view, the covering of the sash 1 on the outer side the room and with regards to the outer seal in combination with the fixed frame 32.

Figure 4:
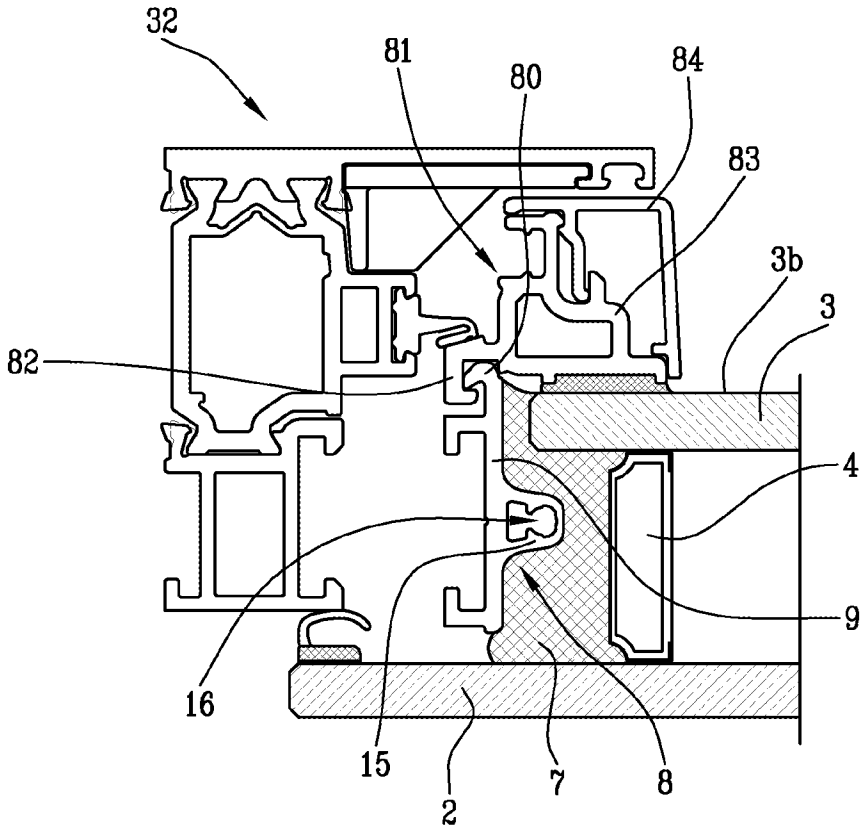
FIG. 4 illustrates a variant embodiment of an edge part of the sash referred to FIG. 2.

An alternative embodiment of this rear covering is illustrated in FIG. 4.

In this solution the containment element 8 has an extension or hook-shaped elastic joint 80 of the base side 9 extending towards the rear side of the sash 1.

The rear covering comprises a profile 81 with thermal insulation properties having a protrusion 82 configured to be coupled, in a removable fashion (and through a hinge-like rotation), to the elastic joint 80.

In other words, the profile 81 (thermal break element) is rapidly and precisely associated with the housing element 8 and, thanks to the hinge-like coupling, can be positioned on the outer surface 3*b* of the sheet of glass 3 in the proximity of the edge of the sheet of glass.

The profile 81, in effect, has a second portion 83 configured to associate with the outer surface 3*b* using adhesion means.

The rear covering also comprises a further plate profile 84 designed for coupling both with the profile 81 (in such a way as to cover the profile 81) and to associate (again with adhesion means) with the outer surface 3*a* of the sheet of glass 3 again in the proximity of the edge.

As regards the remaining components the sash 1, it should be noted that the structural component 7 has sealing characteristics to allow a greater seal of the inner chamber 5 and adhesion characteristics to increase the mechanical characteristics of the double glazing unit formed.

Preferably, each cavity 6 present on the corresponding double glazing structure formed, has a single rigid profile 8 (single piece) extending for the entire length of the side.

Preferably (see FIGS. 2 and 3), and as mentioned previously, the rigid profile 8 comprises at least one anchoring rib 15 projecting from the outer surface of the base side 9 and immersed in the structural component 7.

This rib 15 allows the mechanical seal to be increased between the structural component 7 and the rigid profile 8 in order to guarantee a system for supporting the accessory components which is extremely safe.

It should be noted that the anchoring rib 15 is immersed completely in the structural component 7 for an extension at least at least equal to half of a thickness defined by the structural component 7 (inside the cavity 6).

In light of this, the anchoring rib 15 has the respective longitudinal axes of extension positioned perpendicular relative to the base side 9 of the housing element 8.

It should be noted that the anchoring rib 15 has a profile provided with a tubular chamber 16 to define a form of keel with a partly wedge-shaped cross section of extension.

Thanks to this rib 15 a sort of "structural wall" is obtained which connects, stiffening, the two sheets of glass 2 and 3 by means of the portions of structural component 7 interposed between each sheet of glass and the rib 15.

In light of this, the anchoring rib 15 has the relative contact base with the base side 9 of the housing element 8 with a width at least equal to a third of the length of the base side 9.

All these structural and dimensional features are such that the housing element 8 and rib 15 combine considerable operating flexibility with structural safety of the sash.

Moreover, the simplicity of the solution makes it possible to adapt this structure to any type of the sash with the same or different sheets of glass (as described in more detail below) and with any type of movement (sash, tilt and turn, etc.)

In the sash 1 illustrated, the rigid profile 8 is associated with the structural component 7 in a position asymmetrical relative to the two sheets of glass 2, 3, that is, in a position which is off centre with respect to the width of the cavity 6 corresponding to the distance D between the two sheets of glass 2, 3.

In FIGS. 2 and 3, as already mentioned, the first 2 and the second 3 sheet of glass have equal perimeter dimensions.

In this solution, the structural component 7 occupies the entire volume of the cavity 6 defined.

It should be noted that the structural component 7 in this configuration may protrude from the cavity 6 until wrapping around at least one of the ends of the two sheets of glass 2 or 3.

In light of this, the rigid profile 8 is positioned protruding from the cavity 6.

More specifically, the rigid profile 8, preferably is, but not necessarily, positioned off-centre relative to the cavity 6. In light of this, the rigid profile 8 is positioned with partial overlapping of a free end of one of the sheets of glass 2, 3 wrapped in the structural component 7.

It should be noted that the rib 15 of the rigid profile 8 has an extension S15 calculated from the outer surface of the base side 9 at least greater than the depth P8 of the channel defined by the flaps 10, 11 of the rigid profile 8.

As already mentioned, the channel of the rigid profile 8 houses operating components such as an operating rod 9*a* (see dashed line in FIG. 2 and solid line in FIG. 3) which are slidable inside the channel.

The operating rod 9*a* may be associated, for example, to constraining elements 9*b* such as bosses (see FIG. 2) interacting with striker elements constrained to the fixed frame 32 (not illustrated herein).

Elements 9*c* for constraining the rod 9*a* are applied on the rod 9*a* for connecting with the control handle 9*d* located outside the sash 1 and supported by the second portion 23 of the plate 20.

This invention also provides a fixture for making doors or windows.

The fixture comprises at least:

a sash 1 as illustrated previously;

a fixed frame 32 on which is articulated the sash 1 to define at least a closed configuration, wherein the sash 1 is in contact with the fixed frame 32, and an open configuration, wherein the sash 1 is away from the fixed frame 32; the frame 32 having at least an inner perimeter channel 33 which can be positioned to face the rigid profile 8 of the sash 1, in a closed configuration, and at least a seal 34 placed in contact, in a closed configuration of the sash 1, with one of the portions 29, 30, 31 of the rear profile 28.

Preferably, the rigid plate 20 of the sash 1 has a sealing gasket 26 at the free end of the second portion 23 in contact with at least a contact surface 32*a*, in the closed configuration of the sash 1.

In light of this, a first contact surface 32*a* is formed by an outer surface of the frame 32.

In a structuring of doors and windows with two sashes, for example, another contact surface may be a component 32*b* of the auxiliary sash 1' (see FIG. 2), without thereby limiting the scope of protection of this invention.

Figure 5:
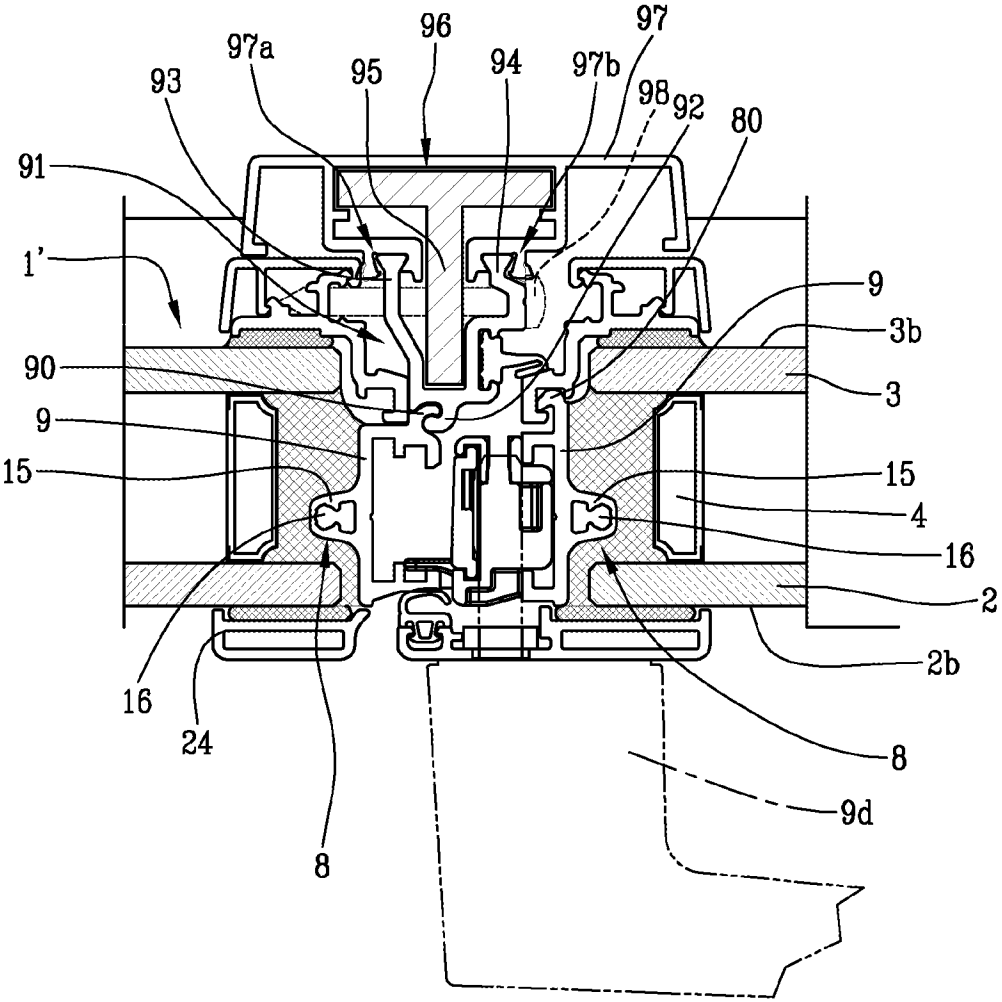
FIG. 5 illustrates a variant of the rear central part of the door or window referred to FIG. 2.

FIG. 5 shows in detail a central part of a door or window with two sashes (main and secondary).

In this configuration (in an enlarged scale compared with that shown in FIG. 2) the secondary sash (in this case labelled 1') comprises the housing element 8 having a hook-shaped elastically compliant extension 90 along the base side 9.

The hook-shaped end of the extension 90 is engaged in a protrusion 92 forming part of a profile 91 with thermal insulation properties.

The protrusion 92 is designed for coupling, in a removable fashion (and through a hinge-like rotation), at the hook-shaped end.

The profile 91 also has two half-bodies 93 and 94 extending towards the rear part of the sash 1'. These half-bodies 93 or 94 are positioned, in use, on opposite sides of the shank 95 of a stiffening body 96 with a T-shaped cross-section. The head of the body 96 is housed in a rear covering profile 97 configured for covering the rear central zones between the two sashes.

The profile 97 has two seats 97*a* and 97*b* for housing the ends of the two half-bodies 93 and 94.

The thermal break profile 91, the covering profile 97 and the stiffening body 96 are joined stably together by a screw element 98 passing transversely between the profile 91 and the shank 95 of the body 96.

In this way, during opening of the secondary sash 1', this group of components move with the sash 1', whilst during closing they allow the correct contact of the components of the main sash 1.

The preset aims are fully achieved with a sash structured in this way.

The sash has an extremely reduced number of components and, consequently, a fast and easy assembly with a reduction in overall costs.

Moreover, this structure makes it possible to adapt the sash to many types of fixed frames without having to change any type of component.

The presence of a perimeter cover structured in such a way as to be interchangeable allows an aesthetic adaptation or a change in appearance of the visible front of the sash which is extremely convenient, simple and low cost.

Moreover, the cover may be used to support technical components in a rational manner and combined with the aim of the appearance, in such a way as to optimise the structure of the sash as a whole.

The invention claimed is:

1. A sash for doors or windows, comprising:

a first and a second sheet of glass positioned facing each other and parallel to each other at a spaced distance;

a spacer and joining element interposed between two inner surfaces facing each other of the first and second sheets of glass to define a first closed inner perimeter zone or chamber and a second open outer perimeter zone or cavity for each side defined by the first and second sheets of glass;

a structural component for at least one chosen from sealing and adhering applied along an outer perimeter defined by the second open outer perimeter zone or cavity; the structural component occupying a volume of the second open outer perimeter zone or cavity to allow contact of the structural component at least with the spacer and joining element and with a part of the two inner surfaces of the first and second sheets of glass;

a housing element for housing accessory components for at least one chosen from supporting and operating the sash, the housing element connected to the structural component, for each side defined by the first and second sheets of glass; each housing element including a rigid profile having, in cross section, at least one closed base side and two flaps, each formed by a transversal stretch transversal to the base side and a recessed stretch, parallel to the base side, to form a channel with an opening; the rigid profile being connected to the structural component at least along an outer surface of the base side;

the rigid profile comprising at least one anchoring rib projecting from the outer surface of the base side and immersed in the structural component; the anchoring rib having, in cross section, a keel extending with a vertex towards the spacer and joining element;

a removable adhesive;

at least one rigid plate, for at least one side of at least one chosen from the first and second sheets of glass, the at least one rigid plate including a first portion connected by the removable adhesive to an edge of an outer surface of at least one chosen from the first and second sheets of glass, opposite a corresponding one of the two inner surfaces, for covering at least a portion of the edge.

2. The sash according to claim 1, wherein the at least one rigid plate comprises a second portion protruding from the edge and parallel to the outer surface.

3. The sash according to claim 2, wherein the rigid plate includes a free end of the second portion including a profile for coupling with a seal.

4. The sash according to claim 2, wherein the second portion includes a through seat for coupling and supporting a member for controlling the sash.

5. The sash according to claim 1, wherein the at least one rigid plate includes a rigid plate for each side of the at least one chosen from the first and second sheets of glass to cover a lateral perimeter of the at least one chosen from the first and second sheets of glass, to be fitted inside a room in which the sash is mounted.

6. The sash according to claim 1, wherein the at least one rigid plate has the first portion including a seat having an inner volume for partially containing the removable adhesive; the removable adhesive being interposed between an inner part of the seat and the outer surface.

7. The sash according to claim 1, wherein the removable adhesive comprises a strip of two-sided adhesive material.

8. The sash according to claim 1, wherein the removable adhesive comprises a strip of the removable adhesive applied between a seat of the rigid plate and the edge.

9. The sash according to claim 1, wherein the first and second sheets of glass have equal perimeter dimensions, and wherein the structural component occupies the volume of the second open outer perimeter zone or cavity and the rigid profile is positioned to protrude from the second open outer perimeter zone or cavity.

10. The sash according to claim 1, comprising a rear covering and a rear removable adhesive connecting the rear covering to a further edge of the outer surface of the other of the at least one chosen from the first and second sheets of glass, the rear covering including a rear profile having a first portion in contact with the further edge, a second portion configured away at least transversely relative to the further edge third portion projecting beyond a free end of the further edge.

11. A fixture for making doors or windows, comprising the sash according to claim 10;

a fixed frame on which is articulated the sash to define at least a closed configuration, wherein the sash is in contact with the fixed frame, and an open configuration, wherein the sash is away from the fixed frame; the frame having at least an inner perimeter channel which can be positioned to face the rigid profile of the sash, in a closed configuration, and at least a seal placed in contact, in a closed configuration of the sash, with one of the portions of the rear profile.

12. The fixture according to claim 11, wherein the rigid plate of the sash includes a sealing gasket at a free end of the second portion in contact with a contact surface, in the closed configuration.

* * * * *